United States Patent [19]

Johnson

[11] Patent Number: 4,926,654

[45] Date of Patent: May 22, 1990

[54] CONTROL ASSEMBLY FOR ADJUSTING THERMOSTAT SETTING

[75] Inventor: Ronald M. Johnson, Louisville, Ky.

[73] Assignee: General Electric Company, Louisville, Ky.

[21] Appl. No.: 410,507

[22] Filed: Sep. 21, 1989

[51] Int. Cl.[5] ..... F25B 49/00

[52] U.S. Cl. ..... 62/229; 236/51; 74/108; 74/501.6; 337/303; 337/312

[58] Field of Search ..... 236/51; 62/229; 74/108, 74/501.6; 337/303, 304, 312

[56] References Cited

U.S. PATENT DOCUMENTS

| | | | |
|---|---|---|---|
| 2,750,117 | 6/1956 | Pascoline | 236/51 X |
| 2,833,478 | 9/1958 | Middleton | 236/51 X |
| 2,855,153 | 10/1958 | Tyler | 236/51 X |
| 3,203,258 | 8/1965 | Grayson | 236/51 X |
| 3,630,046 | 12/1971 | Boor | 62/408 |
| 3,730,019 | 5/1973 | Ballard | 74/108 X |
| 4,325,508 | 4/1982 | Kunz | 236/51 X |
| 4,409,861 | 10/1983 | Sakurai | 74/501 R |
| 4,493,455 | 1/1985 | Pruett | 236/51 X |
| 4,614,092 | 9/1986 | Kim et al. | 62/408 |
| 4,633,724 | 1/1987 | Mochida | 74/501.6 X |
| 4,642,998 | 2/1987 | Kang et al. | 62/187 |
| 4,681,255 | 7/1987 | Drost | 236/51 |
| 4,688,393 | 8/1987 | Linstromberg et al. | 62/187 |
| 4,689,966 | 9/1987 | Nonaka | 62/187 |
| 4,732,010 | 3/1988 | Linstromberg et al. | 62/187 |

*Primary Examiner*—William E. Tapolcai
*Attorney, Agent, or Firm*—Frederick P. Weidner; Radford M. Reams

[57] ABSTRACT

A control assembly for a household refrigerator having a mullion partition separating the freezer compartment and the fresh food compartment with a front face and a bottom panel forming the top of the fresh food compartment. There is a control bracket mounted on the bottom panel at the rear of the mullion partition and this bracket has a circular aperture with two radial notches. A thermostat having a rotatable stem for adjusting the thermostat setting is mounted on the control bracket. There is a rotatable hub member having a circular central portion with radial lugs slightly smaller than the circular aperture and radial notches of the control bracket. The portion of the central portion that projects through the circular aperture and radial notches is rotated to mount the hub member on the control bracket. There is an aperture in the center of the circular central portion to receive the rotatable stem of the thermostat and it is dimensioned to rotate the stem in unison with rotation of the hub member. A lever arm extends radially outward from the central portion of the hub member and there is a push-pull device located inside the mullion partition having one end secured to the lever arm and the opposite end is a manual actuator located at the front of the mullion partition whereby movement of the actuator rotates the hub member which rotates the thermostat stem to adjust the thermostat setting.

7 Claims, 3 Drawing Sheets

CONTROL ASSEMBLY FOR ADJUSTING THERMOSTAT SETTING

BACKGROUND OF THE INVENTION

This invention relates to a control assembly for adjusting a thermostat setting of a household refrigerator.

Household refrigerators are arranged so that the thermostat may be manually adjusted by the user to change the thermostat setting and thus control the temperature inside the refrigerator. In some refrigerators the control to adjust the thermostat is located at the front of the refrigerator and the thermostat is located at the rear of the inside compartment of the refrigerator. In most household refrigerators the evaporator for the refrigerant system is located adjacent the freezer compartment and a portion of the cold air resulting from operation of the evaporator flows into the freezer compartment (below freezing) and a portion is directed to flow into the fresh food compartment (above freezing). Usually the thermostat that controls operation of the refrigerant system is positioned in the fresh food compartment to sense the temperature of the air within the fresh food compartment. It is usually located near where the cold air is introduced into the fresh food compartment which in most cases is at the rear of the compartment. When the temperature inside the refrigerator reaches a pre-set upper limit the thermostat turns on the compressor and the refrigerant system is operated in the normal manner to reduce the temperature of the interior compartment of the refrigerator. When the temperature reaches a pre-set lower limit the thermostat turns the compressor off. It is desirable in these type of refrigerators to mount the thermostat near the rear of the fresh food compartment while the manual control for adjusting the thermostat is mounted at the front of the refrigerator. It is also desirable to provide a structure that allows the control assembly including the thermostat to be mounted without the use of any screws for fastening yet retaining the components of the control assembly in their proper position during manual manipulation of the control components for adjusting the thermostat setting. It is highly desirable to have the control assembly constructed and arranged so that there is ready access to the thermostat should the need arise to repair or replace the thermostat with the rest of the control remaining intact. By this invention such a control assembly is provided.

SUMMARY OF THE INVENTION

There is provided a control assembly for a household refrigerator having a mullion partition separating the freezer compartment and the fresh food compartment with a front face and a bottom panel forming the top of the fresh food compartment. There is a control bracket mounted on the bottom panel at the rear of the mullion partition and the bracket has a circular aperture with two radial notches. A thermostat is mounted on the control bracket and has a rotatable stem for adjusting the thermostat setting. There is a rotatable hub member having a circular central portion with radial lugs slightly smaller than the circular aperture and radial notches of the control bracket, the portion of the central portion and the lugs that project through the circular aperture and radial notches is rotated to mount the hub member on the control bracket. There is an aperture in the circular central portion to receive the rotatable stem of the thermostat and it is dimensioned to rotate the stem in unison with rotation of the hub member. There is a lever arm projecting radially outward of the central portion of the hub member. A push-pull device is located inside the mullion partition and has one end secured to the lever arm of the hub member and the opposite end is a manual actuator located at the front of the mullion partition. By this arrangement movement of the manual actuator by the refrigerator user rotates the hub member which rotates the thermostat stem to adjust the thermostat setting.

DESCRIPTION OF THE PREFERRED EMBODIMENT

Figure 1:
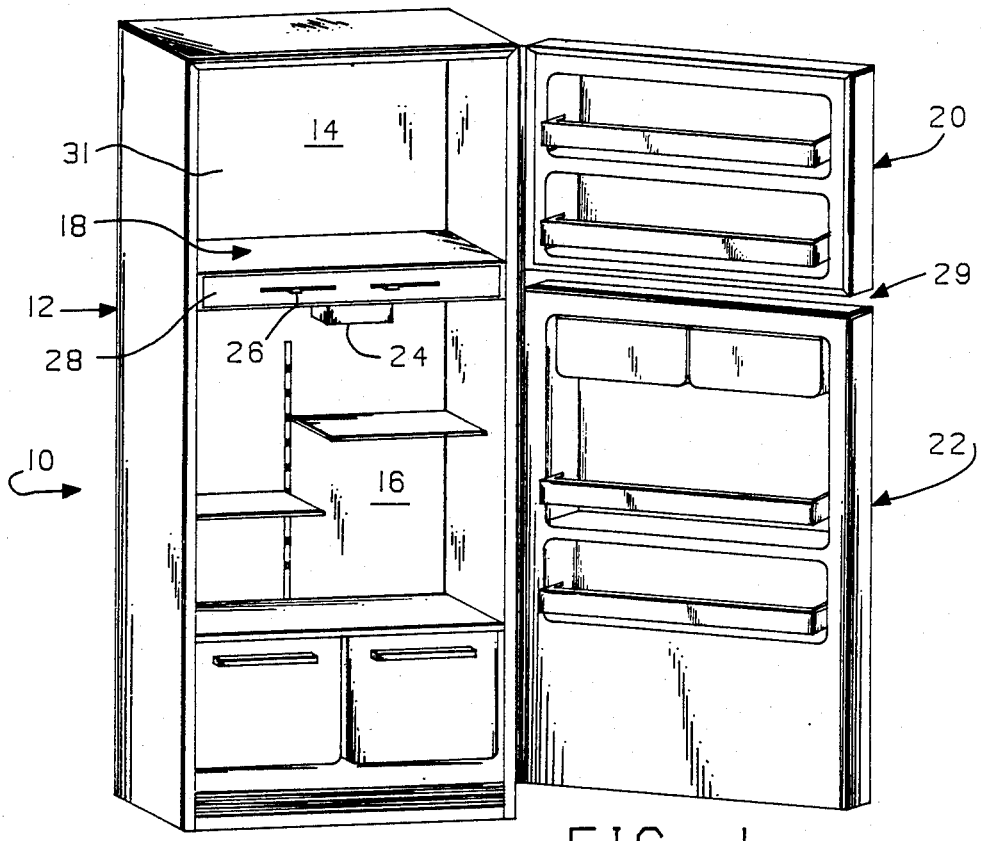
FIG. 1 is a perspective view of a household refrigerator showing the doors of the refrigerator open and the general location of the control assembly of the present invention.
Figure 2:
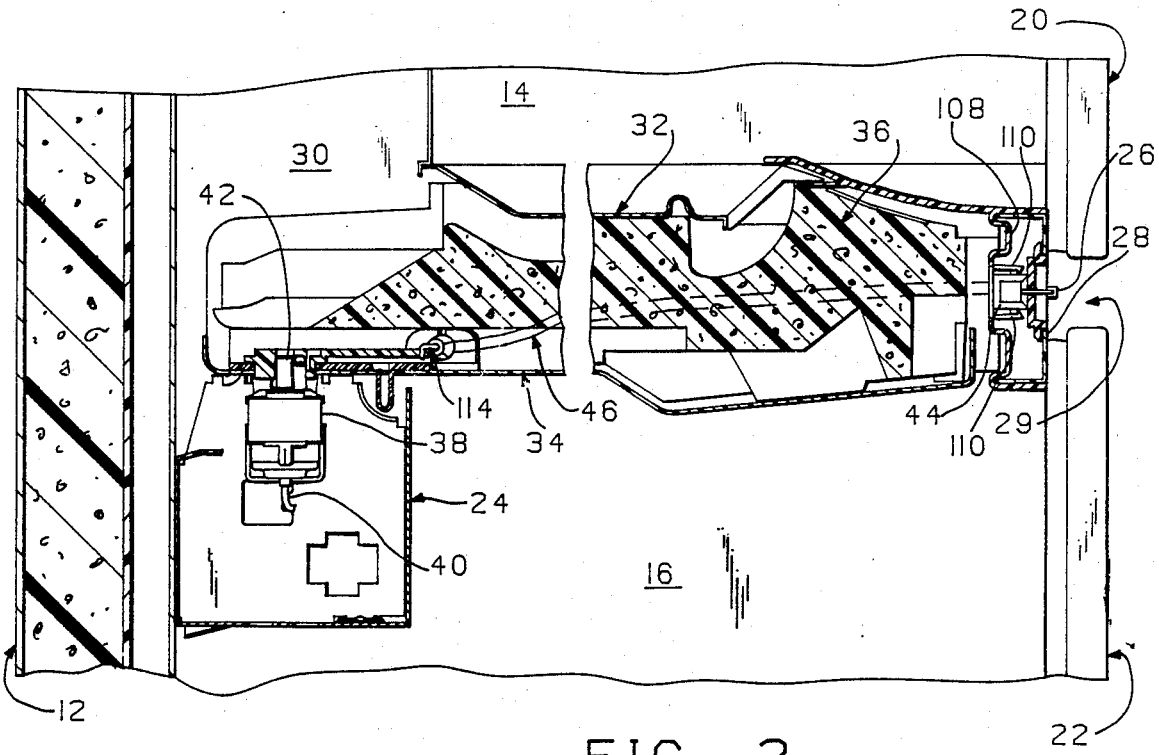
FIG. 2 is a cross-sectional view of a portion of a household refrigerator showing the structural arrangement of the control assembly of the present invention.

With reference particularly to FIGS. 1 and 2 there is shown a household refrigerator 10 having an outer shell 12 and an interior upper freezer compartment 14 and a lower fresh food compartment 16 separated by a mullion partition 18. The freezer compartment 14 has an access door 20 and the fresh food compartment 16 has an access door 22. As shown, the refrigerator normally has numerous pans and shelves for storing food items. Located at the rear of the mullion partition 18 and in the fresh food compartment 16 is a control assembly housing 24. Located at the front of the mullion partition 18 are manual actuators 26, one of which is used by the refrigerator user to control the thermostat setting of the refrigerator. With the location of the manual actuators 26 on the front face 28 of the mullion partition, when the freezer access door 20 and fresh food access door 22 are closed the space 29 between those doors expose the manual actuators 26 so that the user may determine the setting of the manual actuators and adjust them if need be without opening the access doors.

The refrigerant system of the refrigerator includes an evaporator (not shown) which is normally located behind the freezer compartment rear wall 31 and an evaporator fan (not shown) will force the air to circulate through the freezer compartment with a portion being diverted downwardly into the fresh food compartment 16 by means of a duct (FIG. 2). The cold air passes through the control assembly housing 24 into the fresh food compartment.

With particular reference to FIG. 2, the details of the control assembly of the present invention and the mullion partition 18 are shown in the household refrigerator 10. The mullion partition 18 has a generally upper surface or wall 32 which in effect is the bottom or floor of the freezer compartment 14. The mullion partition 18 also has a bottom panel 34 which acts as the top wall of the fresh food compartment 16. Between the upper panel 32 and the bottom panel 34 is thermal insulation 36 so that the difference in temperatures between the freezer compartment and fresh food compartment can be maintained in their proper temperature ranges.

The control assembly housing 24 may be attached to the inside of the fresh food compartment at the rear of the mullion partition 18 by any suitable means. Located within the control assembly housing 24 is a thermostat 38 that has a temperature sensor element 40 that senses the air passing through the control assembly housing 24. The thermostat 38 has a rotatable stem 42 for adjusting the thermostat setting. Located just behind the front face 28 of the mullion partition is an actuator means housing 44 which is secured to the mullion partition 18. Located between the manual actuator housing 44 at the front of the mullion partition 18 and the control assembly housing 24 at the rear of the mullion partition is a push-pull device 46, the operation of which will be discussed later.

Figure 3:
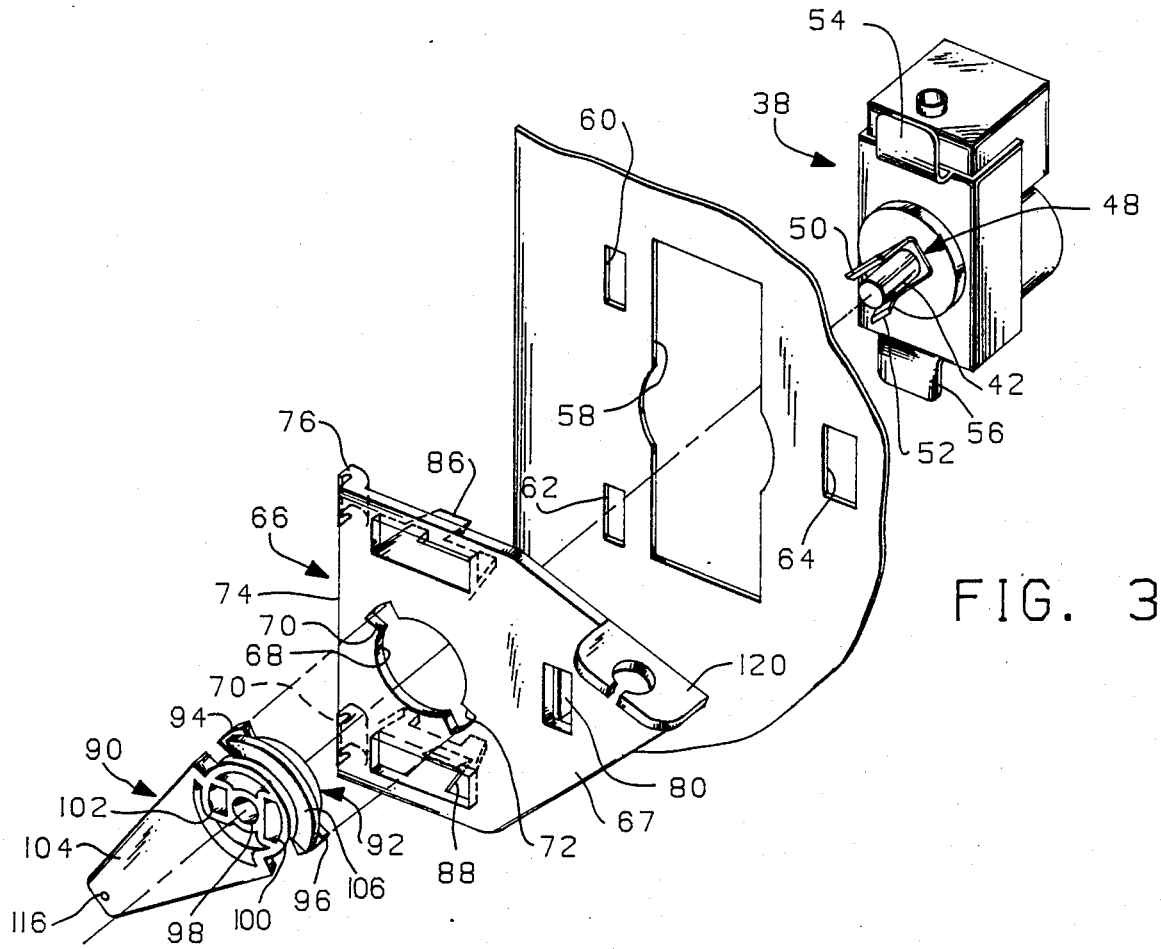
FIG. 3 is an exploded perspective view of a portion of the control assembly of the present invention.
Figure 4:
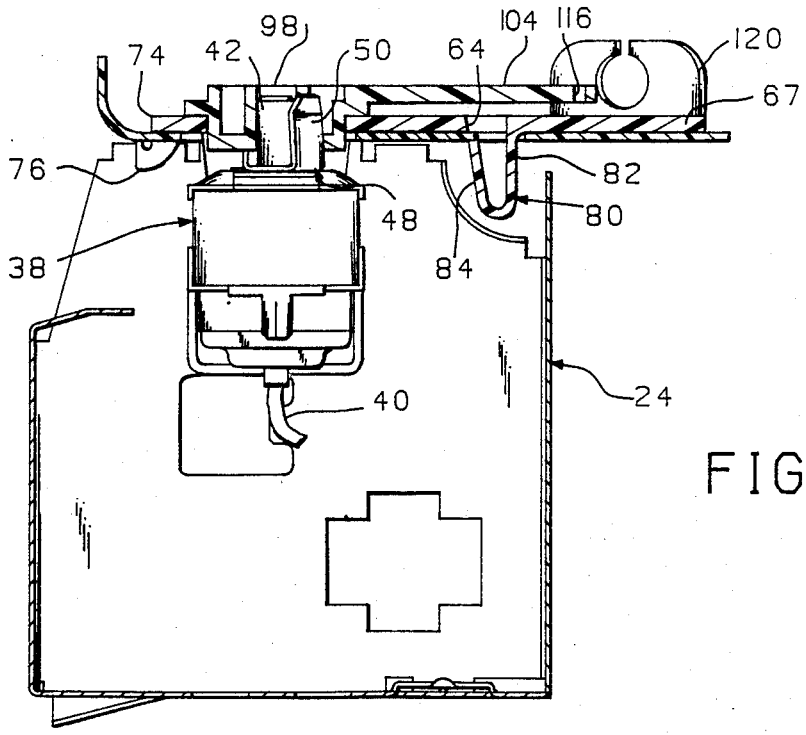
FIG. 4 is a cross-sectional side elevational view of a portion of the control assembly of the present invention showing the component parts of FIG. 3 in their final assembled position.

With particular reference to FIGS. 3 and 4, the details of the portion of the control assembly located at the rear of the mullion partition will be described. In FIG. 3 the exploded view shows the thermostat 38 having a forwardly extending rotatable stem 42. Secured to the stem 42 for rotation in unison thereof is a U-shaped element 48 having one leg 50 wider than the opposite leg 52. The thermostat 38 has outwardly extending flanges 54 at the top and 56 at the bottom. Suitable electric connections (not shown) are also incorporated in the thermostat 38 so that the thermostat may energize and de-energize the compressor of the refrigerant system of the household refrigerator responsive to pre-set temperature limits sensed by the thermostat.

As shown in FIG. 3, forwardly of the thermostat 38 is the bottom panel 34 of the mullion partition. This panel 34 has a cut-out opening 58 corresponding to the body of the thermostat and also there are two spaced apart rectangular openings 60 and 62 to the left of the opening 58 and a rectangular opening 64 located to the right of the opening 58.

Forwardly of the bottom panel 34 is a control bracket 66 which has a circular aperture 68 with two radial notches 70 and 72 180° apart formed in the base 67. Located along one edge 74 of the control bracket 66 at the upper end thereof is a hook shaped element 76 and at the lower portion of the edge 74 is another hook shaped element 78, both of which are dimensioned to be received in rectangular openings 60 and 62 respectively in the bottom panel 34. The control bracket 66 also has a rearwardly extending U-shaped flexible latch element 80 which has one leg 82 secured or molded integrally with the base 67 of the control bracket and the other leg 84 being free to flex back and forth relative to the secured leg 82. The U-shaped flexible latch element 80 is dimensioned to be received in rectangular opening 64 in the bottom panel 34.

The control bracket 66 also has near the top and bottom flexible hook shaped elements 86 and 88 respectively that project rearwardly in the direction of the thermostat 38. These hook shaped flexible elements 86 and 88 are spaced apart and dimensioned to receive the outwardly extending flanges 54 and 56 respectively of the thermostat 38.

Located forwardly of the control bracket 66 is a rotatable hub member 90 having a circular central portion 92 with radial ear-like projections or lugs 94 and 96 which are dimensioned to be received through the radial notches 70 and 72 respectively of the control bracket 66. The circular central portion 92 and the radial lugs 94 and 96 are slightly smaller than the circular aperture 68 and radial notches 70 and 72 of the control bracket 66 so that they may be received therethrough. The circular central portion 92 has an aperture 98 in the center dimensioned to receive the rotatable stem 42 of the thermostat. The circular central portion 92 also has two apertures located radially outward of the center aperture 98 with one of the apertures 100 being larger than the other aperture 102 and these apertures are dimensioned to receive the wider leg 50 and the narrower leg 52 respectively of the U-shaped element 48 secured to the thermostat stem 42. The circular center portion 92 of the rotatable hub member 90 has a flange 106 around the center portion 92 except for the area of the radial lugs 94 and 96 and the flange 106 is spaced from the lugs 94 and 96 a distance slightly greater than the thickness of the control bracket 66. Secured to or molded integrally with the circular central portion 92 of the rotatable hub member 90 is a lever arm 104 which extends radially outward of the central portion 92. In the preferred embodiment the lever arm 104 is in the form of an elongated element; however, any suitable lever arm arrangement such as a wheel, wheel segment or other rotatable element could be used.

The components of the portion of the control assembly shown in FIG. 3 are assembled by passing the radial lugs 94 and 96, which in the preferred embodiment are 180° apart, and a portion of the circular central portion 92 through the circular aperture 68 and radial notches 70 and 72 and then the hub member is rotated so that the lugs 94 and 96 are on one side of the control bracket base 67 and the flange 106 is on the opposite side of the control bracket base 67. This sub-assembly is then secured to the bottom panel 34 by inserting the hook shaped elements 76 and 78 through rectangular opening 60 and 62 respectively and inserting U-shaped flexible latch element 80 through rectangular opening 64 which is dimensioned to receive the latch element. Once the flexible latch element 80 passes through aperture 64 the free leg 84 snaps outwardly and engages the rear surface of the bottom panel 34, thus securing the sub-assembly of the control bracket 66 and rotatable hub member 90 to the bottom panel 34. The thermostat 38 is then positioned behind opening 58 in bottom panel 34 with the thermostat stem 42 being received in aperture 98 of the rotatable hub member 90 and the wider leg 50 and narrower leg 52 of the U-shaped element 48 being received in larger aperture 100 and smaller aperture 102 respectively of the hub member 90. The outwardly extending flanges 54 and 56 are engaged by hook shaped flexible elements 86 and 88 respectively which secures the thermostat 38 to the control bracket 66 and engages rotatable hub member 90 so that rotation of hub member 90 will rotate the thermostat stem 42 in unison therewith. As is normally the case with thermostats adjustable by a rotatable stem, the stem of the thermostat rotates through a radial arc, one end of the arc being the colder setting and the other end being the warmer setting. The thermostat 38, control bracket 66, and rotatable hub member 90 are assembled so that once a portion of the central portion 92 and lugs 94 and 96 of the hub member passes through the circular aperture 68 and radial notches 70 and 72 respectively, the hub member is rotated so that the lugs 94, 96 are not in alignment with the notches 70 and 72 respectively. The U-shaped element 48 of thermostat 38 is aligned with the apertures 100 and 102 of the hub member 90 in such a manner that rotation of the stem 42 will not permit the lugs 94 and 96 to be oriented in alignment with the notches 70 and 72. In this manner then movement of the lever arm 104 to adjust the thermostat by rotating the stem 48 will be such that the hub member will not be disengaged from its rotational position on the control bracket 66.

Figure 5:
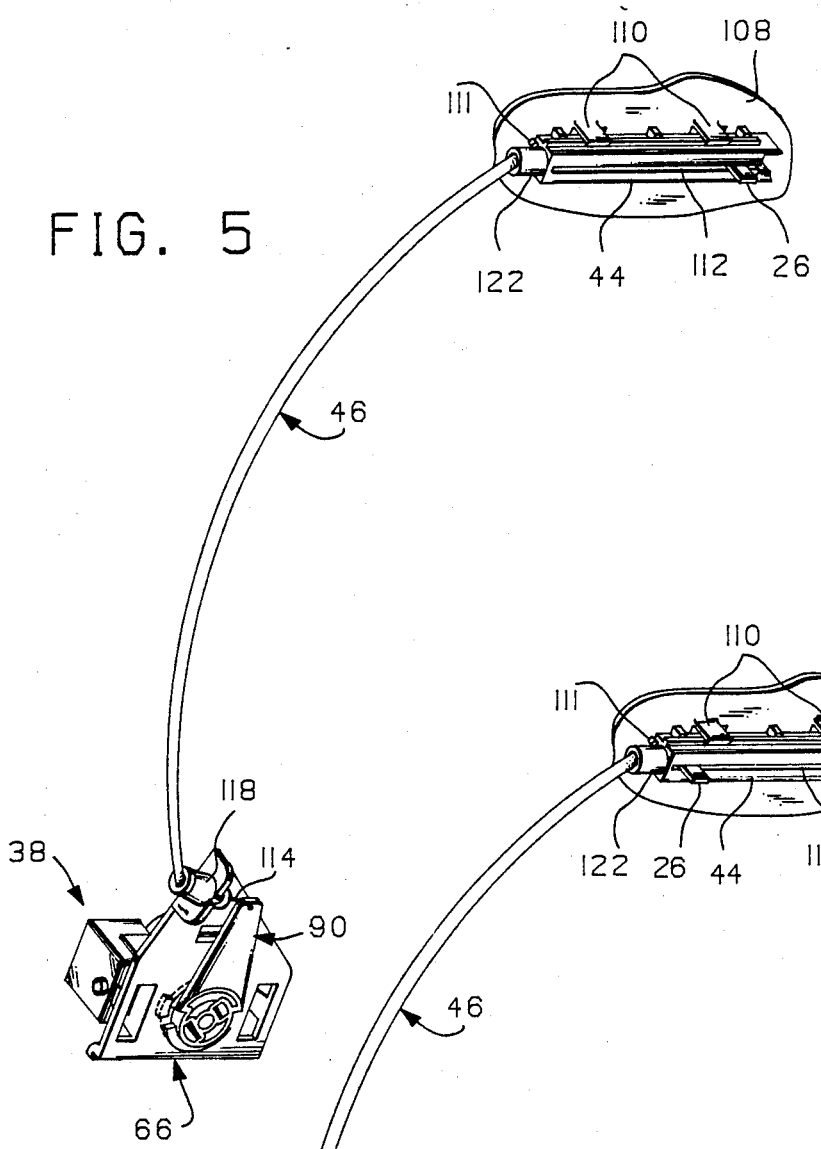
FIG. 5 is a perspective view of the control assembly of the present invention showing one position of the control.
Figure 6:
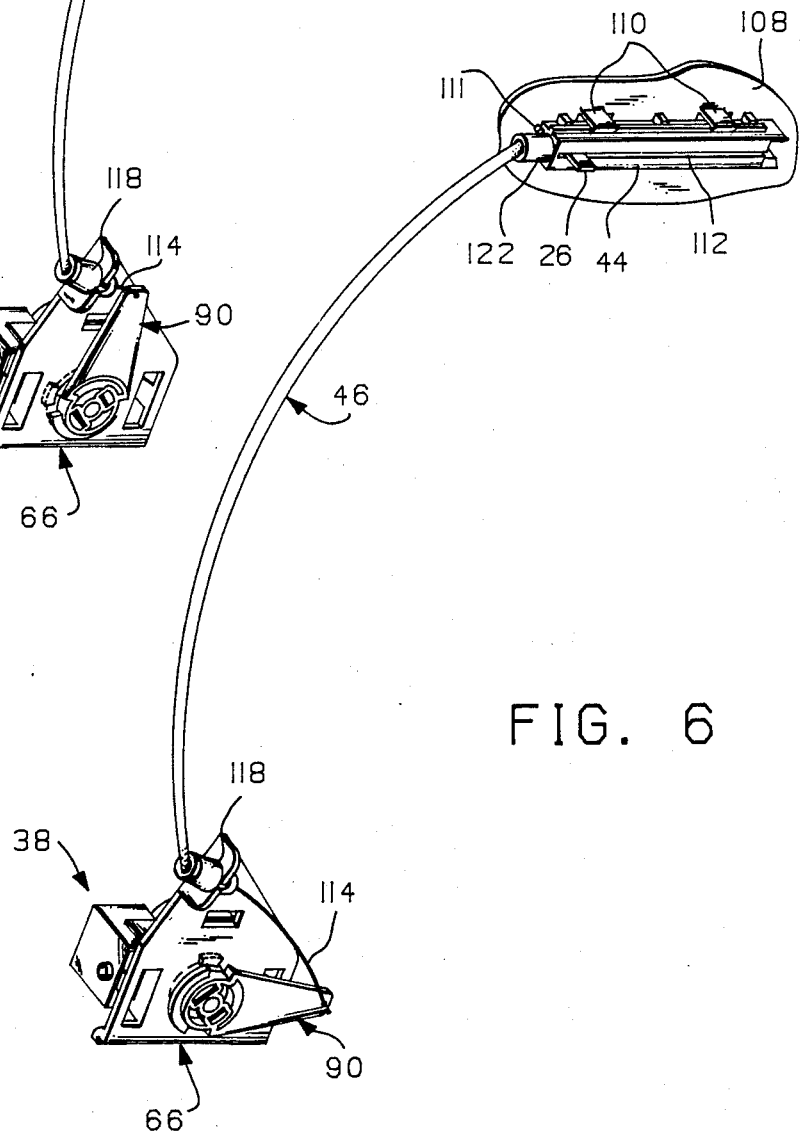
FIG. 6 is a perspective view of the control assembly of the present invention showing another position of the control from that of FIG. 5.

With reference particularly to FIGS. 2, 5 and 6, there is shown the manual actuator 44 for adjusting the thermostat setting located at the front of the mullion partition 18. The mullion partition 18 has at the front thereof a cross member 108 to which is attached the actuator housing 44 as shown particularly in FIGS. 5 and 6. The housing 44 which is in the shape of a rectangular box is retained by a plurality of flexible clip members 110 located on each side of the housing and upstanding projections 111 at each end thereof. The housing 44 has an elongated slot 112 from one end of the housing to the other end. At one end of the housing there is connected a push-pull device 46 which can be a rod or as in the case of the preferred embodiment a cable with a movable center wire 114 which has one end thereof secured to a manual slide actuator 26 at the front of the mullion partition and the opposite end attached to the lever arm 104 of the rotatable hub member 90. Attachment of the movable center wire 114 to the lever arm may be by forming a right angle hook in the wire and passing the distal end through a hole 116 located at the end of the lever arm away from the center portion 92. Retention of the cable on the control bracket 66 may be by a connector 118 secured to a flange 120 perpendicular to the base 67. The cable may be retained on the actuator housing 44 by a connector 122. The push-pull device 46 passes through the interior of the mullion partition by having a suitable cut-out channel for receiving the device. With this arrangement then the refrigerator user may move the actuator 26 along the slot 112 which in turn moves the center wire 114 to push or pull as the case may be the lever arm 104 which in turn rotates the thermostat stem to adjust the setting of the thermostat. Indicia may be provided relative to the actuator 26 to visually indicate the thermostat setting to the user.

It will be noted that with the above described control assembly the thermostat is located below the bottom panel 34 of the mullion partition 18 and can be disconnected and removed from the rest of the control assembly which remains intact inside the mullion partition. This simplifies repair or replacement of the thermostat should the need arise.

It will be further noted that with the above described structural arrangement of the control assembly that there are no screws required for positioning and retaining the components with respect to each other. The control bracket 66, hub member 90 and actuator housing 44 may be molded out of suitable plastic to provide the necessary apertures and clip elements for retaining the respective components in their proper position.

While in accordance with the Patent Statutes, there has been described what at present is considered to be the preferred embodiment of the invention, it will be obvious to those skilled in the art that various changes and modifications may be made thereto without departing from the invention. It is, therefore, intended by the appended claims to cover all such changes and modifications as fall within the true spirit and scope of the invention.

What is claimed is:

1. A control assembly for a household refrigerator having a mullion partition separating the freezer compartment and the fresh food compartment with a front face and a bottom panel forming the top of the fresh food compartment comprising:

a control bracket mounted on the bottom-panel of the mullion partition, said bracket having a circular aperture with two radial notches;

a thermostat mounted on the control bracket and having a rotatable stem for adjusting the thermostat setting;

a rotatable hub member having, a circular central portion with radial lugs slightly smaller than the circular aperture and radial notches of the control bracket with a portion of the central portion and lugs projected through the circular aperture and radial notches and rotated to mount the hub member on the control bracket, an aperture in the circular central portion to receive the rotatable stem of the thermostat and dimensioned to rotate the stem in unison with rotation of the hub member, a lever arm radially outward of the central portion, and a push-pull device located inside the mullion partition and having one end of the device secured to the lever arm of the hub member and the opposite end of the device is a manual actuator means located at the front of the mullion partition whereby movement of the actuator means rotates the hub member which rotates the thermostat stem to adjust the thermostat setting.

2. The control assembly for a household refrigerator of claim 1 wherein the rotatable hub member has a flange spaced from the radial lugs a distance slightly greater than the thickness of the control bracket and has a diameter greater than the inside diameter of the circular aperture in the control bracket so that when the hub member is mounted on the control bracket the lugs are on one side of the control bracket and the flange is on the opposite side of the control bracket.

3. The control assembly for a household refrigerator of claim 1 wherein the rotatable stem of the thermostat has attached to it a U-shaped member having a base and two spaced apart legs, one leg being wider than the other and the central portion of the hub member has two apertures to receive the respective legs of the U-shaped member and each of the two apertures having a dimension slightly larger than the width of the respective leg received therein.

4. The control assembly for a household refrigerator of claim 1 wherein the push-pull device is a cable with a movable center wire.

5. The control assembly for a household refrigerator of claim 4 wherein the manual actuator means is a rectangular housing secured to the front face of the mullion partition and the center wire of the push-pull cable is movable by a horizontally movable tang projecting from the rectangular housing and secured to the center wire.

6. The control assembly for a household refrigerator of claim 1 wherein the two radial notches of the control bracket and the radial lugs of the central control portion of the hub member are 180° apart.

7. The control assembly for a household refrigerator in accordance with claim 5 wherein the rectangular housing of the manual actuator means is secured to the front face of the mullion partition by projecting resilient clips gripping the rectangular housing.

* * * * *